US010787837B2

(12) United States Patent
Butler et al.

(10) Patent No.: US 10,787,837 B2
(45) Date of Patent: Sep. 29, 2020

(54) STRUCTURAL COMPONENTS FOR LIGHTWEIGHT TENTS

(71) Applicant: Mountain Hardwear, Inc., Portland, OR (US)

(72) Inventors: Reese Butler, Portland, OR (US); Keith Phizackerley, Portland, OR (US); Daniel Tachibana, Portland, OR (US); Ben Guthrie, Portland, OR (US); Zachary Goldberg-Poch, Portland, OR (US); Carolina Rodriguez, Portland, OR (US)

(73) Assignee: Mountain Hardwear, Inc., Portland, OR (US)

( * ) Notice: Subject to any disclaimer, the term of this patent is extended or adjusted under 35 U.S.C. 154(b) by 0 days.

(21) Appl. No.: 16/439,128

(22) Filed: Jun. 12, 2019

(65) Prior Publication Data

US 2019/0376311 A1 Dec. 12, 2019

Related U.S. Application Data

(60) Provisional application No. 62/684,110, filed on Jun. 12, 2018.

(51) Int. Cl.

| | |
|---|---|
| ***E04H 15/32*** | (2006.01) |
| ***E04H 15/60*** | (2006.01) |
| ***E04H 15/64*** | (2006.01) |
| ***E04H 15/44*** | (2006.01) |

(52) U.S. Cl.

CPC ..... *E04H 15/64* (2013.01); *E04H 15/32* (2013.01); *E04H 15/44* (2013.01); *E04H 15/60* (2013.01)

(58) Field of Classification Search

CPC ..... E04H 15/32; E04H 15/42; E04H 15/425; E04H 15/60

USPC ..... 135/120.3, 120.4

See application file for complete search history.

(56) References Cited

U.S. PATENT DOCUMENTS

| | | | | |
|---|---|---|---|---|
| 2,440,557 | A * | 4/1948 | Power | E04H 15/42 135/90 |
| 5,261,436 | A * | 11/1993 | Funk | E04H 15/42 135/119 |
| 6,073,642 | A * | 6/2000 | Huang | A45B 9/00 135/114 |
| 6,564,817 | B1 * | 5/2003 | Tseng | E04H 15/64 135/119 |
| 7,607,445 | B2 * | 10/2009 | von Dewitz | E04H 15/425 135/114 |
| 8,776,813 | B2 * | 7/2014 | Delap | E04H 15/60 135/114 |
| 2009/0173369 | A1 * | 7/2009 | Lah | E04H 15/425 135/121 |

(Continued)

*Primary Examiner* — Noah Chandler Hawk

(74) *Attorney, Agent, or Firm* — Schwabe, Williamson & Wyatt, P.C.

(57) ABSTRACT

Embodiments herein describe various structural components for a lightweight tent. Structural components include a split tip for a tent pole end, configured to receive and secure one or more cords from a tent canopy. The one or more cords may be configured with stoppers that may fit into corresponding recesses on the split tip to assist in retention. Other components include a coupler for attaching one or more cords from the tent canopy. The coupler may be secured to a tent pole section by a retaining ring, or by cooperation of a groove in the tent pole with a corresponding ridge on the coupler.

11 Claims, 15 Drawing Sheets

(56) References Cited

U.S. PATENT DOCUMENTS

| | | | | |
|---|---|---|---|---|
| 2012/0167935 | A1* | 7/2012 | Lee | E04H 15/60<br>135/120.3 |
| 2013/0174883 | A1* | 7/2013 | Jin | E04H 15/44<br>135/143 |
| 2014/0251400 | A1* | 9/2014 | Jin | E04H 15/32<br>135/120.3 |

* cited by examiner

STRUCTURAL COMPONENTS FOR LIGHTWEIGHT TENTS

CROSS-REFERENCE TO RELATED APPLICATION

This application claims the priority benefit of the earlier filing date of U.S. Provisional Application No. 62/684,110, filed Jun. 12, 2018, which is hereby incorporated herein by reference in its entirety.

TECHNICAL FIELD

Embodiments herein relate to the field of camping gear, and more specifically, to various structural apparatuses and improvements to lightweight tents.

BACKGROUND

When selecting gear for outdoor travel and recreation, such as hiking and camping, gear weight can be an important factor. Reducing gear weight can allow a person to carry more gear and/or reduce fatigue, especially when the person is tackling challenging hikes or treks. A tent is a fundamental piece of camping gear that is commonly carried any time a person undertakes an overnight hike or camping trip. A tent is typically constructed from a canopy and a fly (unless specifically designed to be a "single wall" tent) constructed from a weather-resistant fabric that is held in shape by a rigid yet flexible frame. The frame may be manufactured from a variety of materials, such as composites, fiberglass, or aluminum, and may attach to the canopy by various methods, such as a series of pockets, fasteners, or a combination of the same.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

Figure 1A:
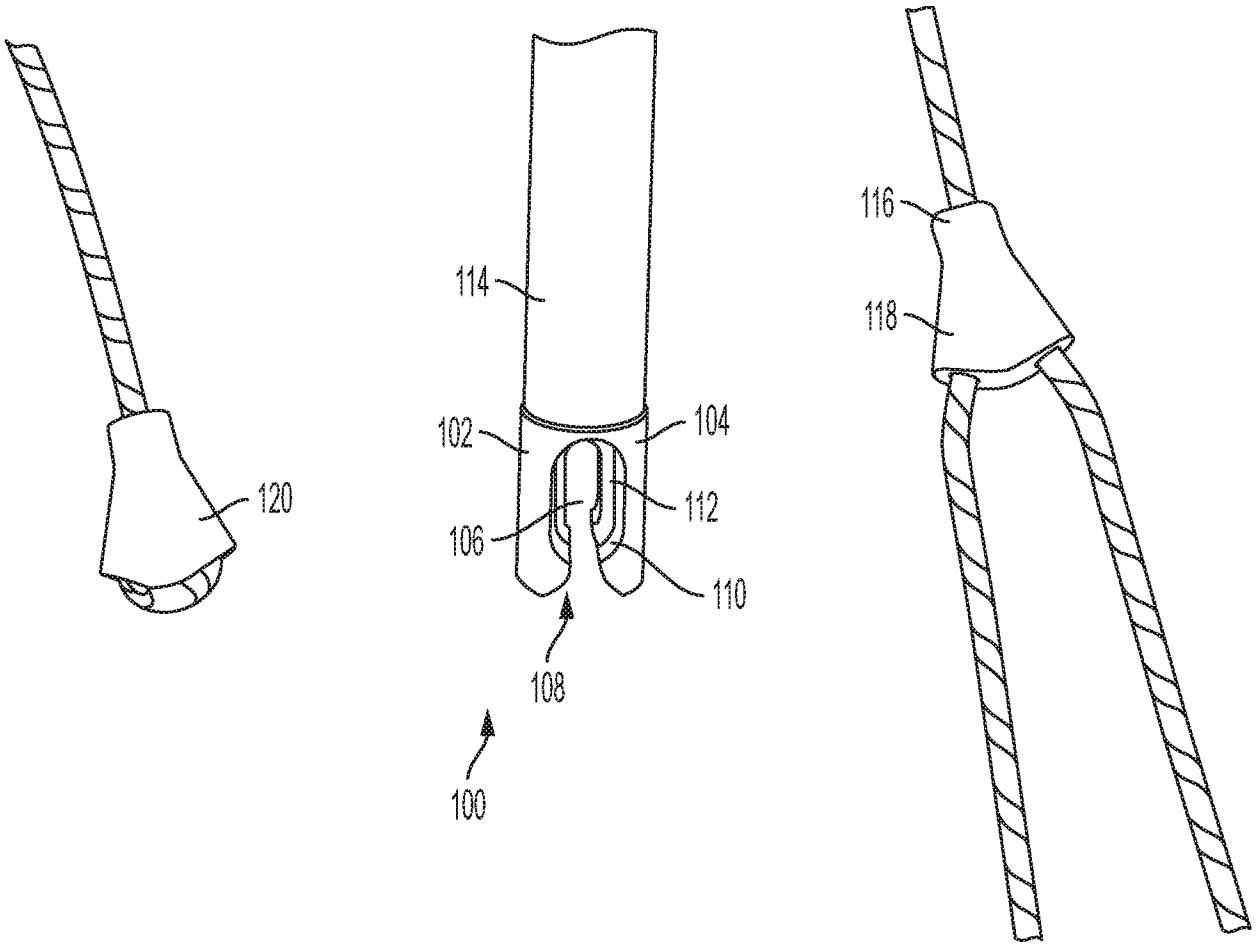
FIGS. 1A and 1B illustrate a first tip for a tent frame member and cooperating attachments, according to various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

A typical tent includes a series of poles for the frame, with each pole comprised of collapsible sections that are connected together via an elastic cord that runs through the center of each section. The cord is secured to the tips of each end section. The tent may be erected by snapping the sections of each pole together, then attaching the poles to the tent canopy. In some examples, each pole may be run through a corresponding channel or tunnel sewn into the canopy. In other examples, the canopy may be fitted with a series of fasteners, such as a hook, snap, clip, loop, or hook and loop material, which may allow the canopy to attach to each tent pole.

The ends of each pole may be secured to the canopy by various means. For example, some tents include a receiving pocket on the canopy, into which a tent pole end may be inserted. Other examples may include a grommet or similar fixture, into which the tent pole end may insert or otherwise be secured. The grommet and/or pole tip may be manufactured from metal which, while durable, may add undesirable weight. Further poles may be used to erect and attach the rain fly and/or tent brow.

The materials used to construct the tent can be selected to be lightweight, such as a thin, lightweight, yet durable fabric for the canopy and rain fly, and materials such as carbon fiber or aluminum for the tent poles. To obtain further weight savings, various structural components for attaching the canopy and/or fly to the poles are disclosed. The structural components allow for replacing the channels or tunnels, which take up unnecessary weight due to additional fabric being required. Moreover, fabric can be prone to ripping, and, in implementations where the structural components pass through a fabric tunnel, can be cumbersome to deploy, requiring the poles to be threaded through their respective tunnels. Instead, a series of discrete connectors are disclosed to hold the canopy to the frame, using cords and associated stoppers.

Embodiments disclosed herein include apparatuses for both improving the speed of a tent deployment, as well as potentially reducing weight and/or improving durability. Split tip ends, manufactured from engineering plastic in some embodiments, can speed attachment and subsequent removal of various bungee cords needed to tension a tent canopy. Various hooks, affixed to tent pole segments, enable erecting a canopy without the need to pass a tent pole through a fabric channel, instead allowing the canopy to be suspended at various points by simply hooking a loop, tie, bungee, or similar cord or rope around its corresponding hook.

Split Tips

FIG. 1A depicts a first embodiment of a split tip 100 for a tent pole. Split tip 100 may be configured with a first half 102 and a second half 104. The halves 102 and 104 together define a slot 106, which may end in an opening 108 distal from the end of tent pole 114. First half 102 and second half 104 each may have part of a first recess 110 and a second recess 112, which can be seen to surround slot 106. First and second recesses 110 and 112 may be sized to receive stoppers 118 and 120. Each stopper may include a portion 116 that may be sized to fit within one of the first or second recesses 110, 112. The stoppers may receive cords extending from a tent canopy or rain fly, to allow the canopy or fly to be removably connected to the tent pole 114.

Figure 1B:
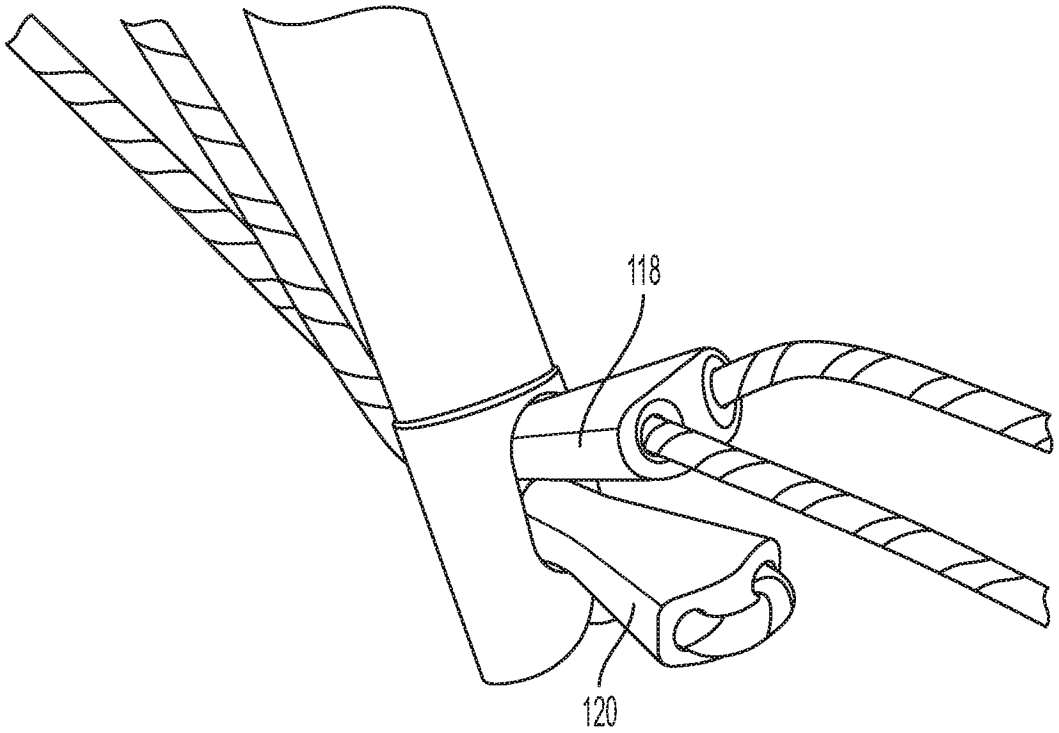

FIG. 1B shows split tip 100 in use. Also referring to FIG. 1A, cords pass through stoppers such as stoppers 118 and 120, and the portions 116 of each stopper are disposed within corresponding first and second recesses 110, 112. Each cord passing from each stopper may be passed through opening 108 and into slot 106. The portion 116 of each stopper may then be fitted into a corresponding recess 110 or 112. In a tent, each pole may be flexed into an arcuate shape, and so provide an outward-directed force that tensions an attached tent canopy. The first and second recesses 110 and 112 may be positioned to face away from the canopy, so that when the pole is flexed and under tension, the stoppers 118 and 120 are tensioned away from the canopy. This tension acts to pull each portion 116 into its corresponding recess 110, 112, thereby removably securing the stoppers into each split tip 100. The recesses 110 and 112 help to keep stoppers 118 and 120 secured to split tip 100, to prevent a corresponding tent canopy from becoming detached from its frame. The cords attached to stoppers 118 and 120 are likewise placed under tension, which transfers to the tent canopy to help keep the canopy in operating shape and erect.

In other embodiments, first and second recesses 110 and 112 may be located on both lateral sides of slot 106, e.g. the sides through which the cords pass. Such a configuration may provide some weight savings and increase ease of tent erection by reducing the need for the user to orient the tent pole 114 to locate the recesses. Further, split tip 100 may, depending upon tent configuration, have more or fewer than two recesses, potentially to accommodate the number of stoppers presented by a given tent design. Still further, slot 106 may, in embodiments, be configured with a narrowing in one or more places that is slightly less than the normal diameter of the cord, to act as a block to resist the cord from slipping out of slot 106.

Split tip 100 and stoppers 118 and 120 may be made from any suitable material that is sufficiently strong and durable while also lightweight. Materials found to be suitable include 6061 aluminum alloy, acetal (POM/delrin), or polycarbonate. Other materials such as nylon/polyamide, glass filled nylon, or another composite or similar material may also be used. Material selection considerations may include the anticipated use of the tent, desired weight savings targets, longevity/durability of the various tent components, and designed component lifespan.

Figure 2A:
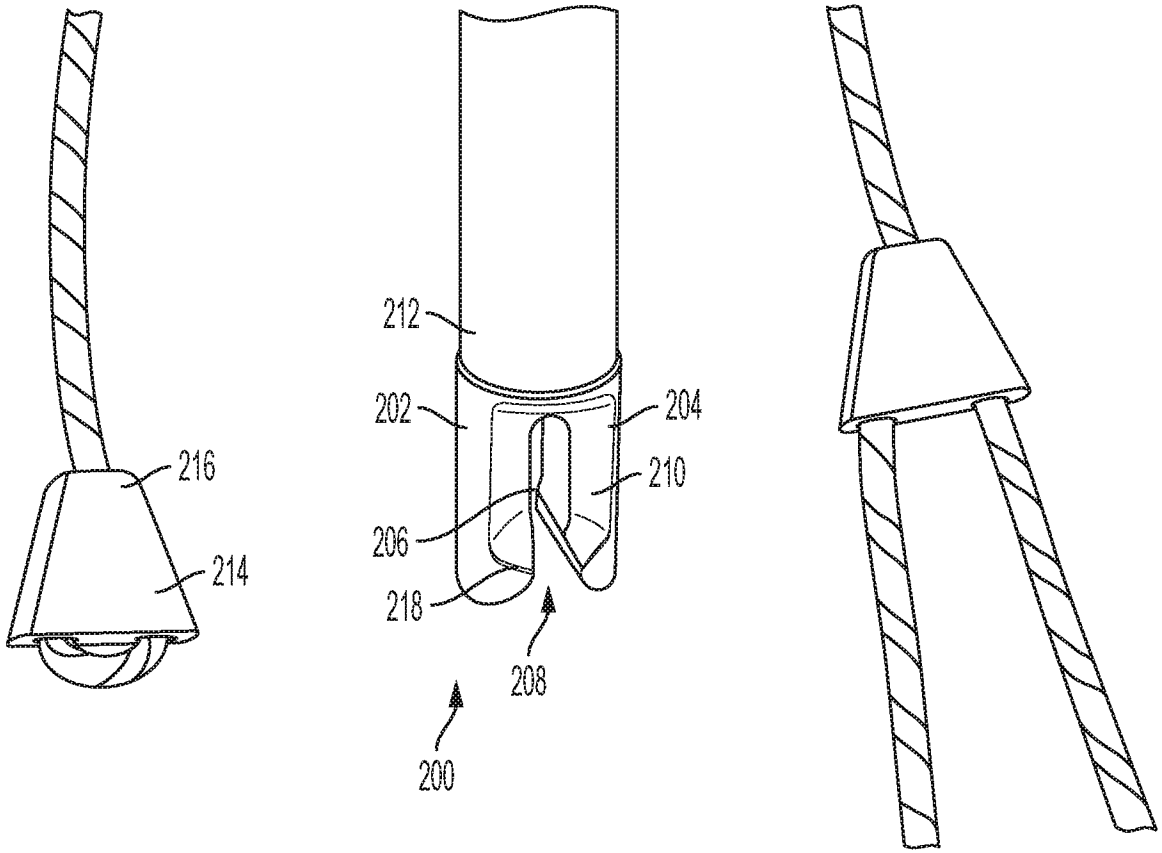
FIGS. 2A and 2B illustrate a second tip for a tent frame member and cooperating attachments, according to various embodiments.

Referring to FIG. 2A, a second embodiment of a tip, split tip 200, is depicted, attached to an end of a tent pole 212. Split tip 200 includes first half 202 and second half 204, which define slot 206 that opens to opening 208. In contrast to split tip 100, split tip 200 includes a flat 210, as opposed to one or more recesses, that may be configured to accept a conical-shaped stopper 214 with a corresponding flat end 216. Flat 210 may terminate in a ridge or protrusion 218 at the end of each half 202 and 204, to assist in retention of the cord. Similar to slot 106, slot 206 may, in embodiments, be configured with a second narrowing or protrusion in one or more places intermediate within slot 206 that is slightly less than the normal diameter of the cord, to act as a block to resist one or more cords from slipping out of slot 206.

Figure 2B:
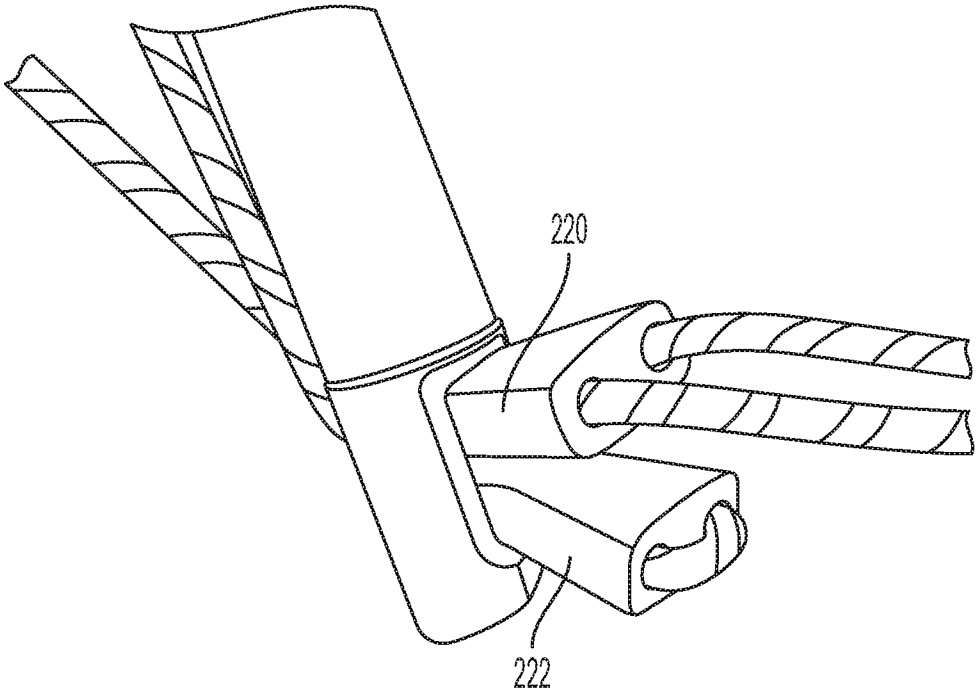

FIG. 2B depicts split tip 200 in use, with two stoppers 220 and 222 attached to split tip 200 via cords connected to a tent canopy and/or fly. As with split tip 100, the cord attached to each stopper may be passed through opening 208 into slot 206. The flat end 216 of each stopper 220, 222 may mate with flat 210 of split tip 200. Depending upon the configuration of the tent canopy, the flat 210 cooperating with flat end 216 may help ensure that the tent canopy does not inadvertently detach from the frame. This may be further assisted by protrusion 218, to prevent a stopper held fast to split tip 200 by tension from the tent pole from slipping down to where the cord could become free through opening 208.

As with the recesses 110, 112 of slot 106, flat 210 may be configured on one or both sides of slot 206 of split tip 200, and further may be made longer or shorter depending on an anticipated number of stoppers that split tip 200 may need to accommodate. Split tip 200 and/or stopper 214 may be manufactured from similar materials as split tip 100, as described above.

Figure 3A:
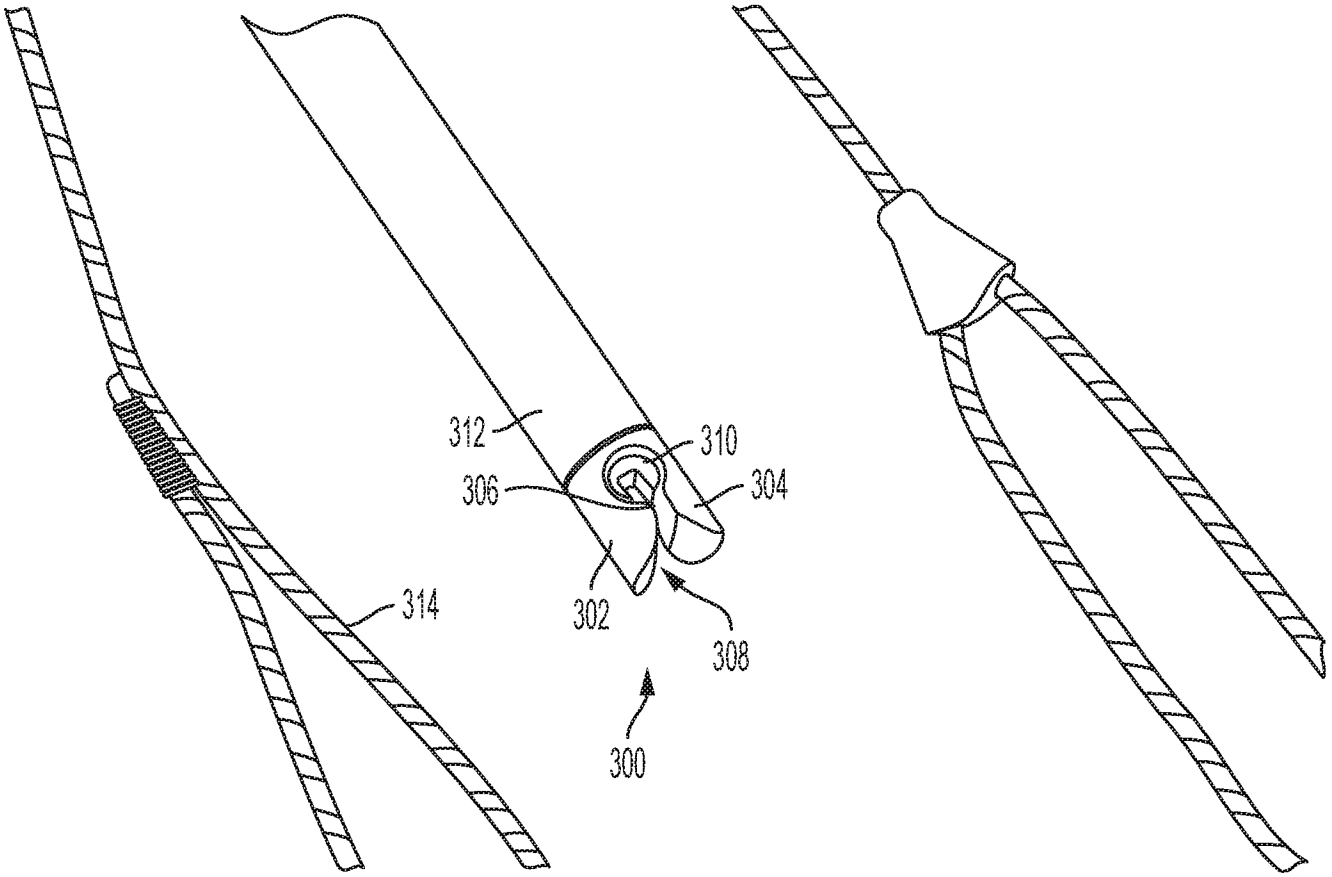
FIGS. 3A and 3B illustrate a third tip for a tent frame member and cooperating attachments, according to various embodiments.

Turning to FIG. 3A, a third embodiment of a split tip, split tip 300, is depicted attached to a tent pole 312. Split tip 300 includes a first half 302 and second half 304, which together define slot 306, which ends in opening 308. Split tip 300 includes a recess 310, similar to recesses 110 and 112 of split tip 100. Split tip 300 is similar to an embodiment of split tip 100, except possessing only a single recess.

Figure 3B:
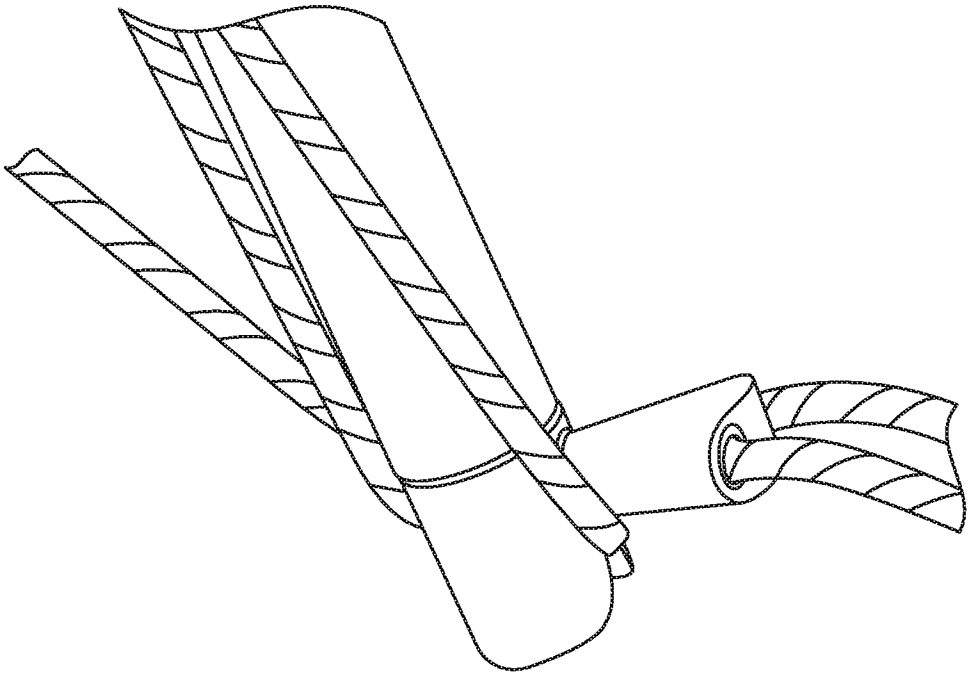

As shown in FIG. 3B, split tip 300 may be configured to accept a stopper with a matching portion similar to portion 116 of stoppers 118 and 120, as well as a plain loop 314 (shown in FIG. 3A) without a stopper. Such an arrangement may be useful where split tip 300 is to accept a stopper attached to a tent canopy cord, and a simple loop 314 that may be attached to a rain fly or tent brow, and so result in a more vertical tension against the tent pole. The simple loop 314, without a stopper, need only rest in the slot 306 without requiring a corresponding recess 310 or protrusion. Split tip 300 and any associated stoppers may be manufactured from any suitable materials as described above with respect to split tip 100. In some embodiments, opening 308 may include one or more protrusions that narrow to a width less than the cord diameter. The narrowing protrusions would cause the cord to compress slightly in passing, thus creating a resistance that must be overcome to move a cord out of the opening 308, thus aiding in retaining the cord.

Figure 4A:
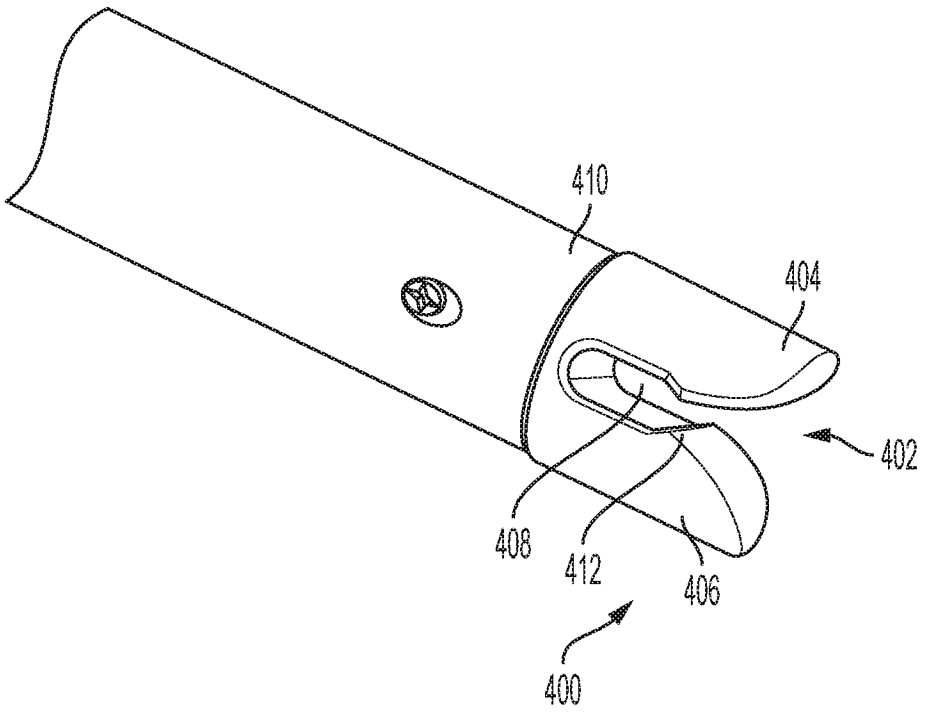
FIGS. 4A and 4B illustrate a fourth tip for a tent frame member and cooperating attachments, according to various embodiments.

FIG. 4A depicts a fourth embodiment, split tip 400, attached to tent pole 410. Split tip 400 includes an opening 402 into a slot 408, defined by a first half 404 and second half 406. Unlike split tips 100, 200, and 300, split tip 400 includes a simple slot 408, without a flat or recess. Each half 404 and 406 may include a protrusion 412, positioned just after the mouth of opening 402, oriented to the interior of slot 408. As with the protrusions described above with respect to FIGS. 1A to 3B, the protrusion may create a narrowing that is less than the diameter of an inserted cord, requiring resistance to pass and thus aiding to retain cords inserted into slot 408.

Figure 4B:
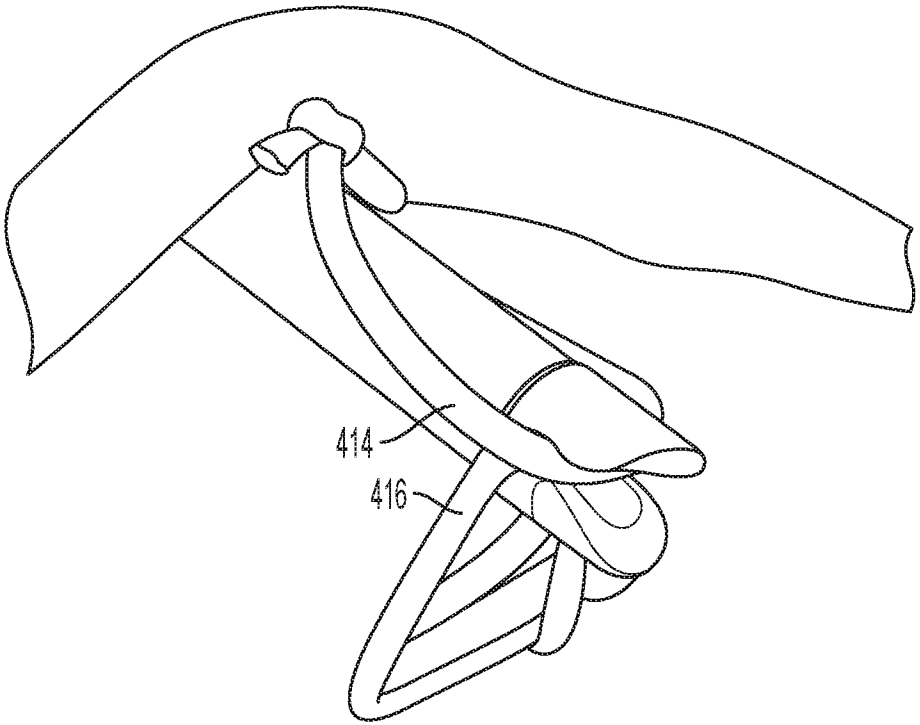

FIG. 4B show split tip 400 with simple loops 414 and 416 inserted into slot 408. As discussed above, protrusion(s) 412 may cooperate to help retain loops 414 and 416 into split tip 400. Slot 408 may be configured to any suitable length to accommodate an anticipated number of loops. Split tip 400 may be manufactured from any suitable materials as described above with respect to split tip 100.

It should be appreciated that other embodiments of split tips may be possible, depending upon the nature of the cords and stoppers (if any) that are used. For example, if the cords used are in the nature of flat straps, a split tip with a substantially narrower slot configured to accept a strap on its edge may be configured. Alternatively or additionally, the slot may be configured to accept two cords in a side-by-side fashion, rather than stacking along the longitudinal axis of the tent pole. Such embodiments are within the scope of this disclosure.

Each of split tip 100, 200, 300, and 400 may be attached to the end of its corresponding tent pole via any suitable method. Such methods may include a press fit, threaded fit/screw-in, crimping or dimpling in one or more locations of the tent pole, adhesives, welding, mechanical fastening, or any other suitable fashion, either permanent or removable.

Couplers

FIGS. 5-12 depict various embodiments of a coupler that may be used, for example, to attach or couple cords or portions of a tent canopy to a tent pole. As discussed above, some example tents may employ one or more fasteners affixed to the canopy, which in turn may attach to each tent pole. These fasteners may be prone to sliding or moving about each tent pole, which may complicate tent erection and decrease stability of the erected tent. In contrast, the coupler may be affixed to a tent pole section 502 via a collar 504, from which a coupling portion 506 extends. The coupler may thereby provide a relatively stationary mounting point on the pole by which a tent canopy may attach to the tent pole frame, such as via one or more loops 508. Tent pole 502 may be equipped with multiple couplers for various canopy attachments. By using multiple couplers, the implementation of one or more tunnels or channels sewn into a tent canopy may be eliminated in favor of a series of loops 508. The combination of loops 508 and corresponding couplers may offer a lighter weight alternative to a series of channels sewn across the length or width of a tent canopy.

Figure 5:
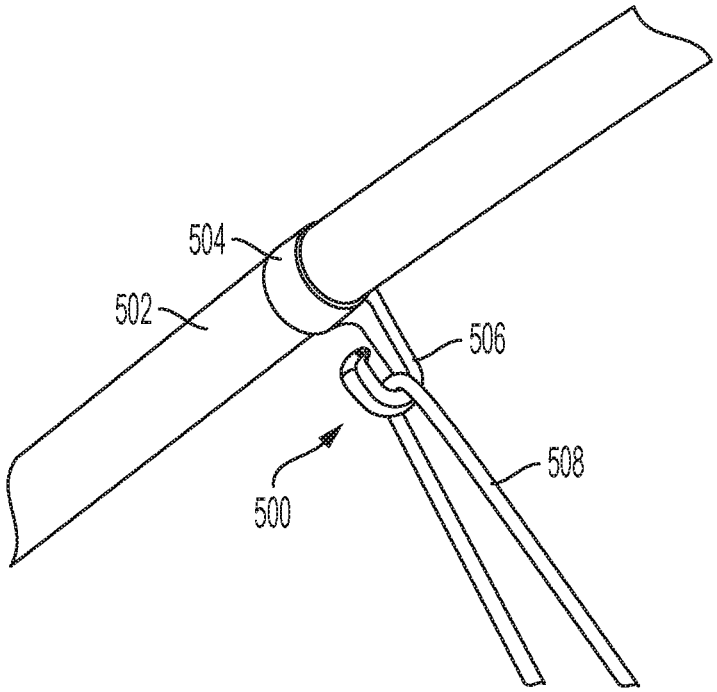
FIG. 5 illustrates a coupler for attaching tent components, according to various embodiments.

As depicted in FIG. 5, a first possible embodiment for coupler 500 is a G hook, so named because its profile shape resembles the lowercase letter "g". Coupling portion 506 is thus depicted as a hook protrusion that opens in a plane orthogonal to the longitudinal axis of section 502. In other embodiments, coupling portion 506 may be implemented as a snap, clasp, buckle, loop, hook or loop material, or any other suitable mechanism for removably securing a point on a tent canopy to the tent pole, or such other scenarios where coupler 500 may be deployed.

Coupler 500, and more particularly, collar 504, may be manufactured from a variety of materials, similar to those that may be used to manufacture a split tip 100, 200, 300 or 400. Coupler 500 may be manufactured from polyamide/nylon 6 with 20% glass fiber fill for reinforcement (PA6-GF20), acetal (POM/delrin), or 6061 aluminum alloy, in a machined fashion. Other suitable materials, including plastics such as polycarbonate or composites, metals, wood, or another similar material or materials may be employed. Depending upon how coupling portion 506 is implemented, collar 504 may be manufactured from the same or a different material than collar 504.

FIGS. 6 through 10 depict various configurations by which a coupler 500 may be secured in various locations to a section of tent pole 502. Each configuration shows how coupler 500, by way of collar 504, may be secured proximate to where two sections of tent pole 502 may be connected. Tent pole sections may connect in a nesting fashion, with one end having a slightly larger diameter to accept a portion of an adjoining section. Alternatively, each tent pole section may attach to a ferrule 606. The ferrule 606 may be configured with an outer diameter that is slightly smaller than the inner diameter of each hollow tent pole section, so that each tent pole section may slide over a portion of the ferrule 606 with minimal play. As will be seen in each of the following FIGS. 6 through 10, only one tent pole is depicted, with the a remaining portion of ferrule 606 visible. In various embodiments, ferrule 606 may be a part of the adjoining tent pole, as discussed above, that is configured with a smaller outer diameter than inner diameter of the joining tent pole. In some embodiments, one portion of ferrule 606 may be permanently affixed into an end of a tent pole, so that it is prevented from sliding within or being removed from the tent pole.

The length of tent pole sections may be selected with respect to a desired spacing of attachment points for a tent canopy. Alternatively or additionally, collar 504 may only be placed at a subset of joints between tent pole sections, as needed.

Figure 6:
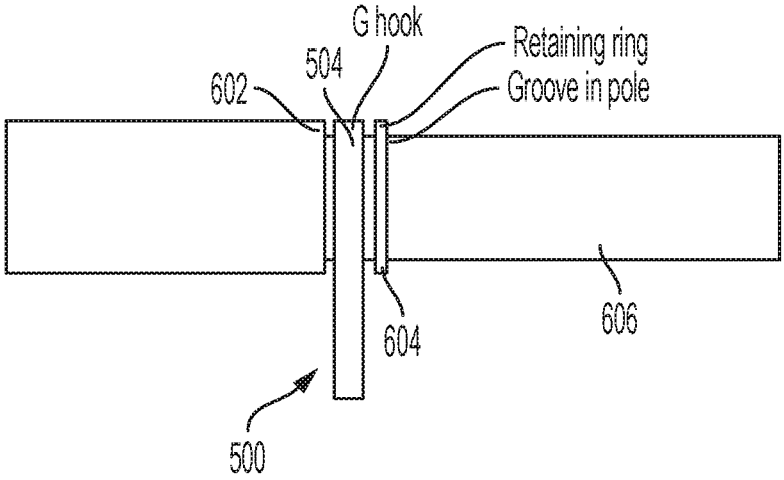
FIG. 6 illustrates a first configuration for securing the coupler of FIG. 5 to a tent frame component, according to various embodiments.

FIG. 6 depicts a coupler 500 secured between sections, which is retained using a retaining ring 604. The larger diameter section may provide a flange 602, against which collar 504 may abut. The larger diameter section may either be formed as a step in an end portion of a tent pole section, or from the end of the tent pole section where ferrule 606 protrudes. The retaining ring 604, placed against the opposite side of collar 504, may be secured in place via a corresponding groove positioned in the smaller diameter section or ferrule 606 (depending upon the particular embodiment). Alternatively, the retaining ring 604 may be press-fit onto the section/ferrule 606, or attached by another suitable means, such as welding, soldering, or adhesives. The retaining ring 604 may be manufactured from metal, plastic, or another suitable material.

Figure 7:
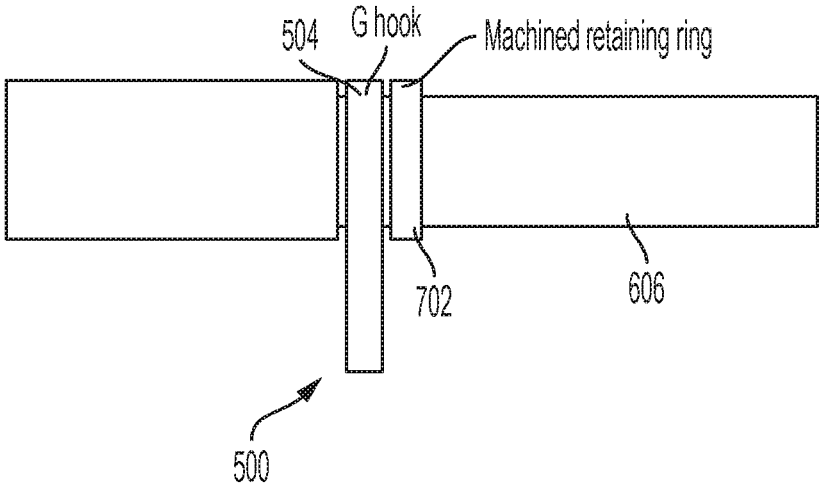
FIG. 7 illustrates a second configuration for securing the coupler of FIG. 5 to a tent frame component, according to various embodiments.
Figure 11A:
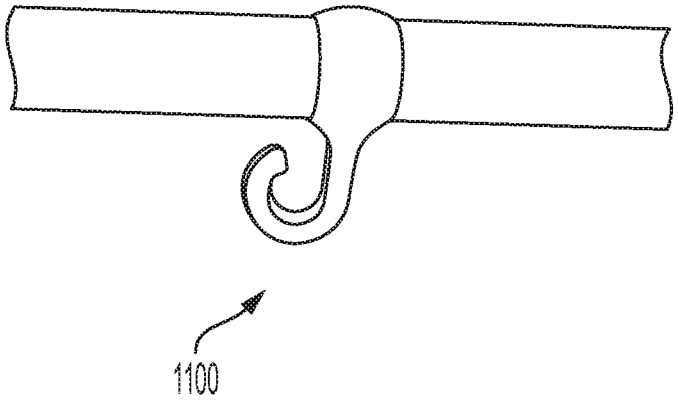
FIGS. 11A and 11B illustrate two possible alternative configurations for the coupler of FIG. 5, according to various embodiments.
Figure 11B:
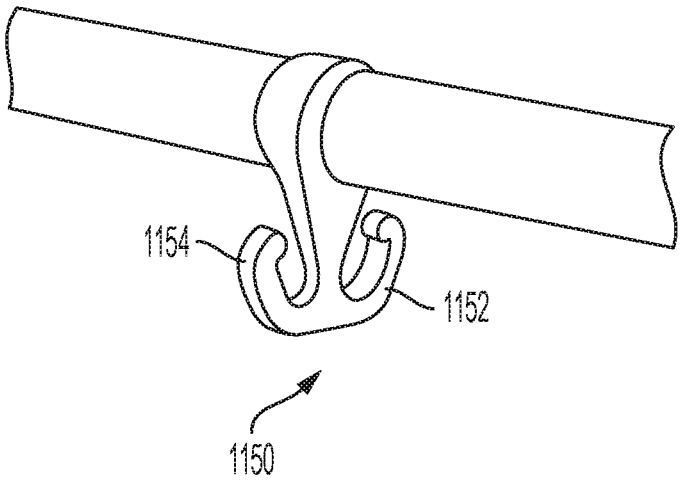

FIG. 7 depicts a variation of FIG. 6; the retaining ring 702 is manufactured from machined metal or plastic, and is of a wider width than the retaining ring in FIG. 6. The retaining ring in FIG. 7 may be mounted and secured similar to the retaining ring of FIG. 6. Alternatively, retaining ring 702 may be formed as a part of and integral with ferrule 606, or, in embodiments, a narrower end portion of the tent pole section. An adjoining tent pole section may abut retaining ring 702, or may be configured with a slightly larger inner diameter for a short portion from its end to accommodate retaining ring 702, as will be understood by a person skilled in the relevant art. In still other embodiments, the adjacent tent pole section may act as the retaining ring. In such embodiments, the coupler 500 may have a body that is hollow with a constant inner diameter that is just larger than the diameter of ferrule 606, but smaller than either tent pole section. Coupler 500, in such embodiments, is slipped over the ferrule and retained by each tent pole section that abuts either side of the coupler 500. FIGS. 11A and 11B depict a possible external appearance of such a configuration.

Figure 8:
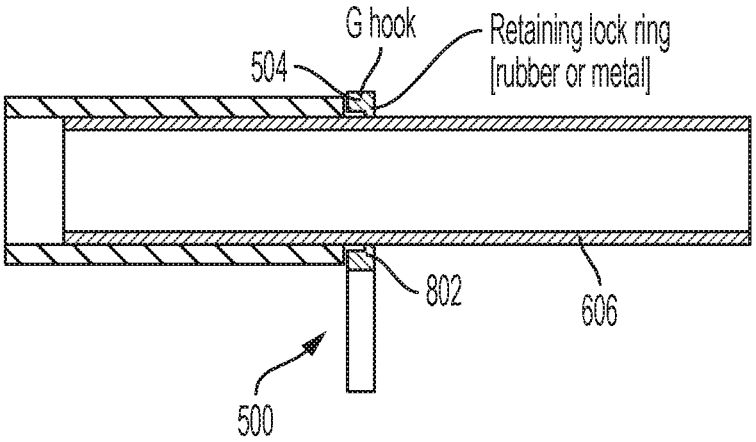
FIG. 8 illustrates a third configuration for securing the coupler of FIG. 5 to a tent frame component, according to various embodiments.

FIG. 8 (which also depicts the nesting configuration of the tent pole sections or use of a ferrule 606), depicts coupler 500 retained using a retaining lock ring 802, which may be manufactured of metal, rubber, plastic, or another suitable material, that abuts and possibly is overlapped by collar 504 of coupler 500. As shown, collar 504 may further have a recess to accommodate the lock ring 802.

Figure 9:
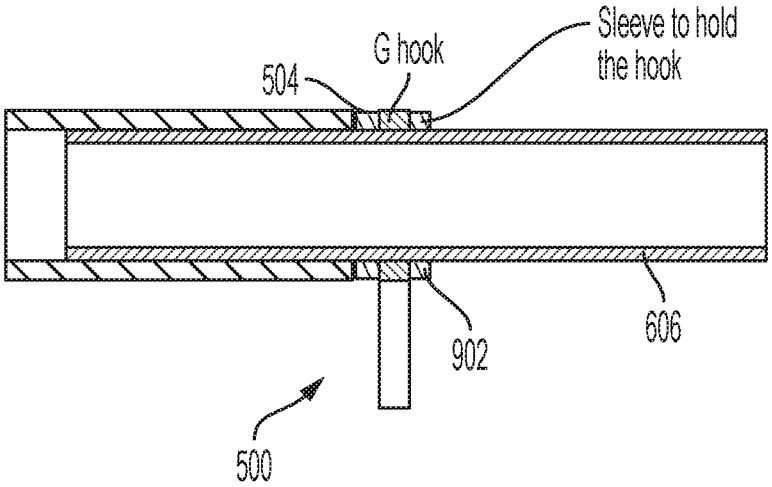
FIG. 9 illustrates a fourth configuration for securing the coupler of FIG. 5 to a tent frame component, according to various embodiments.

In FIG. 9, rather than have collar 504 of coupler 500 abut the larger diameter tent pole section, coupler 500 is secured by a sleeve 902 that surrounds the tent pole section, over which collar 504 of coupler 500 is placed. The sleeve 902, depending on how sized, may allow coupler 500 to be positioned mid-span on a tent pole section, rather than proximate to where two sections connect. The sleeve may be configured with a groove into which the collar 504 of coupler 500 may rest, to assist in its retention. Alternatively, the sleeve may be straight or smooth-sided, with no groove, and collar 504 may be sized to slip or press-fit over the sleeve. As will be understood, alternatively a tent pole section may fit over the section end/ferrule 606, and abut the opposite end of sleeve 902.

Figure 10:
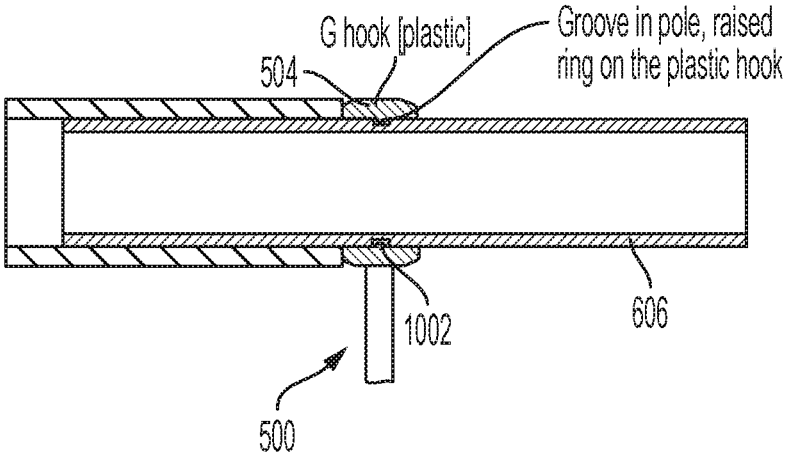
FIG. 10 illustrates a fifth configuration for securing the coupler of FIG. 5 to a tent frame component, according to various embodiments.

FIG. 10 depicts a coupler 500 that includes a ridge 1002 in the internal surface of collar 504, to interface with a corresponding groove in a tent pole section/ferrule 606. Collar 504 may be manufactured from plastic in such an embodiment to facilitate placing coupler 500 onto the tent pole section/ferrule 606, or another suitable material that can be (slightly) stretched for placement into the groove. Alternatively, collar 504 may be manufactured with metal and placed into the tent pole section groove using heat expansion. Although collar 504 is depicted as abutting the larger diameter tent pole section, collar 504 (and thus coupler 500) may be retained anywhere along the tent pole section that the groove may be placed.

FIGS. 11A and 11B each depict an alternative implementation of the coupler. In FIG. 11A, coupler 1100 is similar in configuration to the G hook configuration of coupler 500, however, the coupling portion is created 90 degrees from coupling portion 506. As a result, the hook defines a plane substantially in line with the longitudinal axis of the tent pole. In FIG. 11B, coupler 1150 has a second coupling portion 1154 that opens 180 degrees from the first coupling portion 1152, effectively creating a mirror half compared to the hooked coupling portion 506 of coupler 500. Such a configuration may be useful where cords from a tent canopy may approach from opposing directions.

Figure 12:
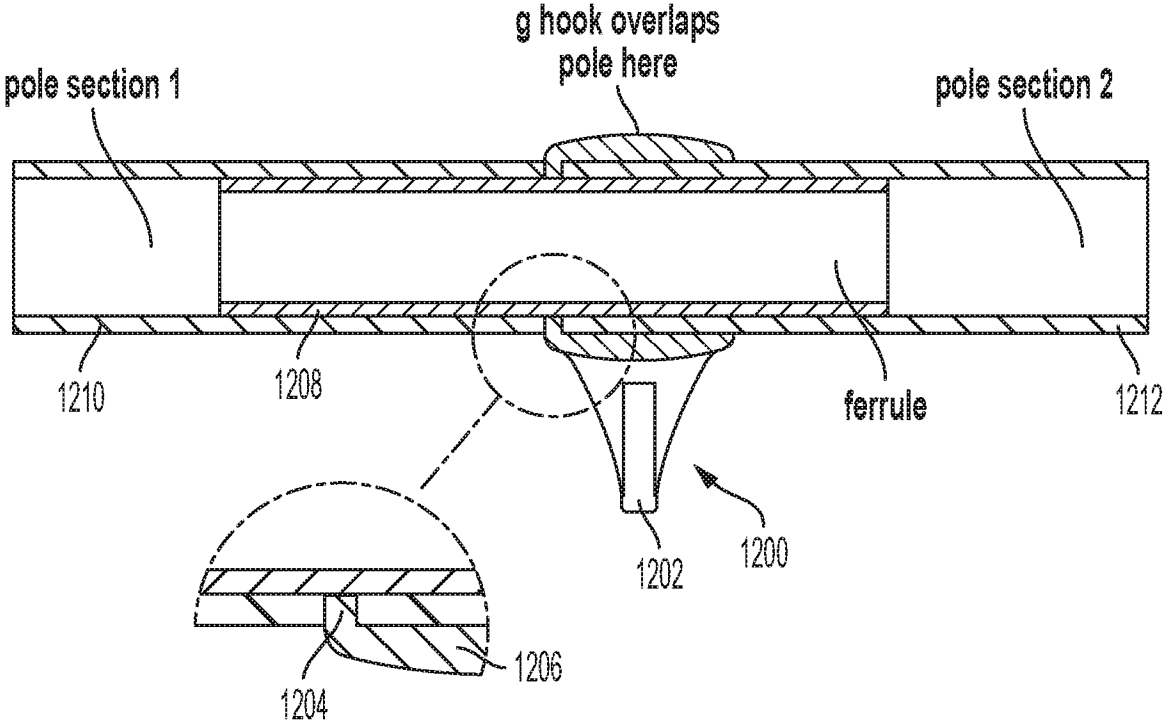
FIG. 12 illustrates an alternative configuration for the coupler of FIG. 5 including a retention flange, according to various embodiments.

FIG. 12 depicts another possible embodiment of the G hook coupler configuration. In the depicted embodiment, coupler 1200 includes a coupling portion 1202, configured as a hook with a profile that resembles the letter "g", similar to coupler 500. As with coupler 500, coupling portion 1202 may be implemented as a snap, clasp, buckle, loop, hook or loop material, or any other suitable mechanism for removably securing a point on a tent canopy to the tent pole. The coupling portion 1202 extends from a hollow tubular body 1206, which includes at one end a flange 1204 that extends radially inward into the hollow center of body 1206. Flange 1204 allows coupler 1200 to be secured to one or more tent pole sections, such as sections 1210 and 1212.

In the example configuration depicted in FIG. 12, a ferrule 1208 couples section 1210 to section 1212. As seen, the ferrule 1208 is of an outer diameter that is slightly smaller than the inner diameter of each pole section 1210 and 1212. The outer diameter of ferrule 1208 can allow each pole section 1210 and 1212 to slide over a portion of ferrule 1208, while providing a relatively close fit between the pole sections 1210 and 1212 and ferrule 1208 with minimal play when assembled. Where a pole section 1210 may have a different inner diameter of pole section 121, ferrule 1208 may be stepped to accommodate the different pole section sizes.

Prior to fitting one or both pole sections 1210 and/or 1212 over ferrule 1208, in the depicted embodiment coupler 1200 is fit over an end of either pole section 1210 or 1212. Body 1206 has an inner diameter that is slightly larger than the outer diameter of either pole section 1210 or 1212, such that coupler 1200 will slide over the end of pole section 1210 or 1212 but with a minimal amount of play. As discussed above, flange 1204 protrudes radially inward from the inner surface of coupler 1200. Flange 1204 extend radially inward to an inner diameter that is smaller than the outer diameter of pole section 1210 or 1212, and so acts as a stop that prevents coupler 1200 from sliding past the end of either pole section 1210 or 1212. However, the inner diameter of flange 1204 is larger than the outer diameter of ferrule 1208, so that ferrule 1208 can slide unimpeded into the pole section 1210 or 1212 over which coupler 1200 has been placed. In some embodiments, such as depicted in FIG. 12, the inner diameter of flange 1204 is approximately the same as the inner diameter of either pole section 1210 or 1212. It should be understood that coupler 1200 need only be configured to slide over one of pole section 1210 or 1212; the remaining pole section can be of a different size than can snugly accept coupler 1200, such as in embodiments where ferrule 1208 is configured to join tent poles of different sizes.

Following fitting of coupler 1200 over one of the ends of either pole section 1210 or 1212, a portion of ferrule 1208 is passed through flange 1204 and inserted into the pole section, with the remaining exposed portion of ferrule 1208 inserted into the other pole section, resulting in the configuration depicted in FIG. 12. As can be seen, flange 1204 is effectively sandwiched between pole section 1210 and 1212, and supported by ferrule 1208, thus retaining coupler 1200.

Coupler 1200 may be manufactured from the same or similar materials as coupler 500, discussed above. Ferrule 1208, similar to the various ferrules 606 depicted in FIGS. 5-10 above, may be manufactured from plastics, composites, metals such as aluminum, or another suitably durable and potentially lightweight material, depending upon the requirements of a specific implementation.

Figure 13A:
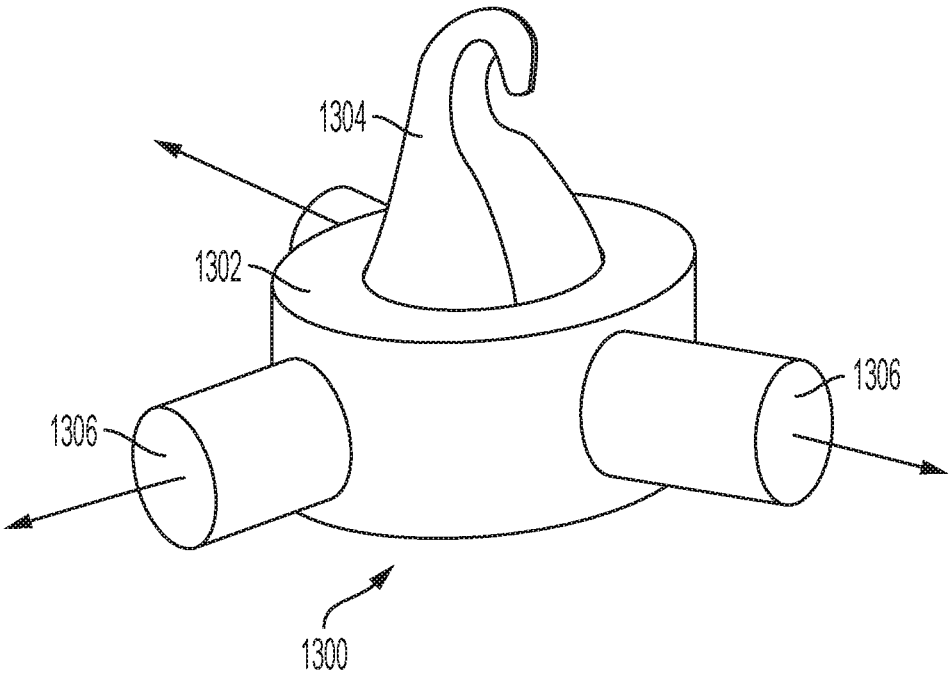
FIGS. 13A to 13D illustrate a coupler configured in a hub and spoke fashion with a removable hook, according to various embodiments.
Figure 13B:
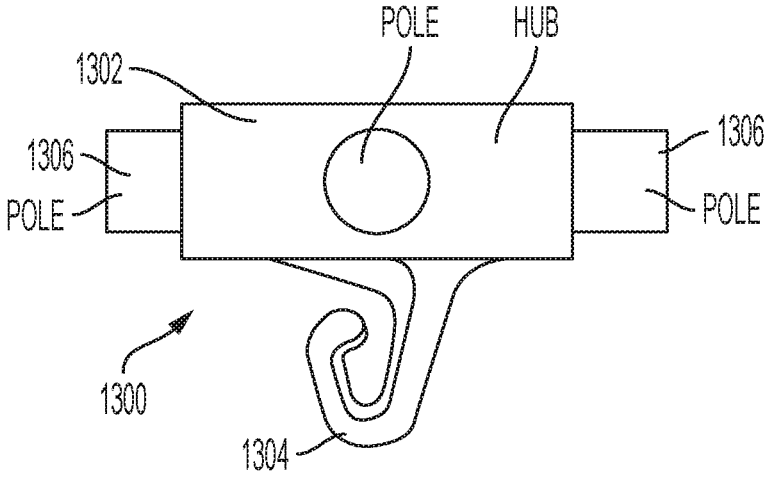
Figure 13C:
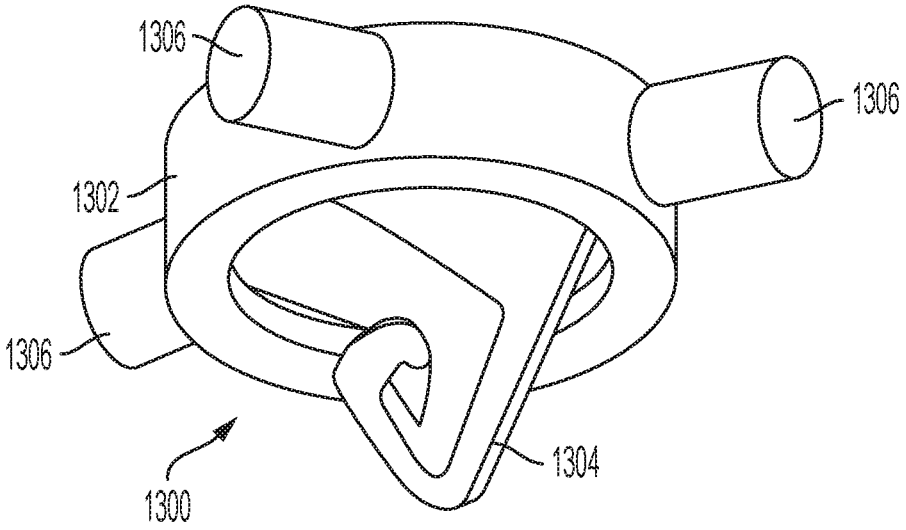
Figure 13D:
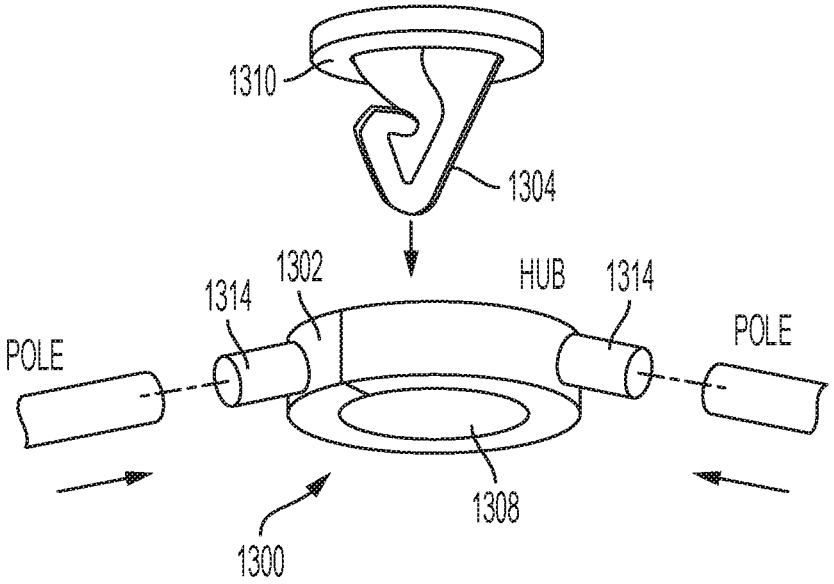

FIGS. 13A-D depict an example coupler 1300 configured to accept two or more tent poles, as well as an insertable G hook. Referring first to FIGS. 13A and 13B, coupler 1300 includes a roughly circular body 1302 that, as seen in FIGS. 13C and 13D, is hollow in its center, effectively forming a ring. Into this hollow center is inserted a hook attachment 1304. As with coupler 500, hook attachment 1304 may be implemented as a snap, clasp, buckle, loop, hook or loop material, or any other suitable mechanism for removably securing a point on a tent canopy to the tent pole. An end of each of a plurality of tent poles 1306 are inserted into the circular body 1302 about its outer circumference, such that body 1302 acts as a hub, with each pole corresponding to a spoke on a wheel. The number of poles 1306 that insert into body 1302 depends upon the specifics of a given embodiment; as depicted, three poles 1306 inserted into body 1302.

In one possible embodiment, each pole 1306 may insert into body 1302 into a corresponding recess formed in the outer circumference of body 1302. In such a configuration, each recess is sized to have an inner diameter that is slightly greater than the outer diameter of the pole 1306 it receives, such that each pole inserts with a minimal amount of play. In another possible embodiment, body 1302 may have a plurality of protrusions that each correspond to one of the poles 1306. Each protrusion may extend radially outward from the side of body 1302, and be sized with an outer diameter that is slightly smaller than the inner diameter of each pole 1306, so that each pole 1306 is retained by sliding over each corresponding protrusion. Each pole 1306 is then retained to body 1302 with a minimal amount of play. This later embodiment is depicted in FIG. 13D, where an end 1312 of a pole can be inserted onto a protrusion 1314. As these are examples, a given body 1302 may employ another method of retaining each pole 1306 as appropriate to a given implementation. In some embodiments, body 1302 may be configured with a mix of retention means, including both recesses and protrusions.

FIGS. 13C and 13D provide a view of hook attachment 1304, and how it inserts into body 1302. As seen in FIG. 13C, hook attachment 1304 protrudes through an opening from one side of the hollow center of body 1302. Hook attachment 1304, in embodiments, is retained via a flange, protrusion, or other physical block that holds hook attachment 1304 in place in the hollow center of body 1302, and allows a load placed upon hook attachment 1304 to be transferred to the tent poles 1306 retained to body 1302. FIG. 13D provides an exploded view, demonstrating how hook attachment 1304 may be inserted into body 1302. Hook attachment 1304 includes a roughly disc-shaped and flattened base 1310. Base 1310 includes an outer circumference that is sized smaller than the inner diameter of at least a portion of body 1302, such that base 1310 can insert into the hollow center of body 1302. Another portion of body 1302, however, has an inner diameter or other obstruction that prevents base 1310 from passing completely through body 1302, thereby allowing base 1310 to be retained within body 1302. It will be recognized that, in such a configuration, base 1310 may only be insertable into body 1302 from one side. In other configurations that rely upon a removable protrusion, such as a set screw, base 1310 may be able to pass completely through body 1302, and is retained by insertion of the screw, a pin, or a similar sort of protrusion.

In some embodiments, such as depicted in FIGS. 13C and 13D, body 1302 is open on opposing sides. One of the sides may be equipped with a flange that extends radially inward from the interior surface of body 1302 to a diameter that is smaller than the diameter of base 1310, but large enough to allow hook attachment 1304 to pass through. Thus, base 1310 rests upon the flange, with hook attachment 1304 protruding past the flange. In other embodiments, the interior of body 1302 may be tapered with a narrowing inner diameter, such that base 1310 may not pass completely through body 1302. In still other embodiments, a mechanical means of retention such as a set screw or one or more protrusions that extend radially inward from the inner wall of body 1302 may retain base 1310. In some embodiments, one or more of the tent poles 1306 may pass completely through the side of body 1302 and into the hollow center, and may either abut base 1310, or overlap base 1310, effectively locking it into position in body 1302. In other embodiments, base 1310 may at all times be able to be removed from body 1302, and is retained in position during use by tension from an object attached to the hook attachment 1304, which biases it against the flange or narrowed portion of body 1302.

As with coupler 1200, coupler 1300, possibly including hook attachment 1304 (and base 1310), may be manufactured from the same materials as coupler 500, described above. Coupler 1300 and hook attachment 1304 may be manufactured from the same or different materials.

The following are potential example embodiments:

Example 1 includes a split tip for attaching to a pole end, comprising a first end that attaches to the pole end; and first and second halves extending from the first end, spaced apart to define a slot, the slot ending in an opening sized to allow a cord to be received into the slot.

Example 2 includes the subject matter of example 1, or some other example herein, wherein the first and second halves further define a recessed portion through which the slot runs, the recessed portion retains the cord by retaining a stopper attached to the cord.

Example 3 includes the subject matter of example 1, or some other example herein, wherein the split tip comprises a body that is cylindrical in configuration, and the first and second halves further define a flat surface in the cylindrical body configured to abut with a corresponding flat surface on a stopper attached to the cord.

Example 4 includes the subject matter of any of examples 1-3, or some other example herein, wherein the slot is sized to accommodate a plurality of cords.

Example 5 includes the subject matter of example 4, or some other example herein, where each of the plurality of cords is equipped with a stopper.

Example 6 includes the subject matter of any of examples 1-5, or some other example herein, wherein the slot includes a protrusion that narrows the slot to a width less than the diameter of the cord.

Example 7 includes a method for mounting a coupler upon a tent pole section, comprising providing a coupler with a coupling portion and a collar portion, the collar portion sized to receive a sleeve; and securing the coupler to the tent pole section by fitting the sleeve over the tent pole section, and fitting the collar portion over the sleeve.

Example 8 includes a method for mounting a coupler upon a tent pole section, comprising providing a coupler with a hook portion and a collar portion, the collar portion sized to receive a tent pole and including an interior ridge; and securing the coupler to the tent pole section by sliding the collar portion over the tent pole section until the interior ridge engages with a corresponding groove in the tent pole section.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Moreover, the embodiments described in the various figures may be mixed and matched as appropriate for an intended purpose without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A coupler for securing a point on a tent canopy to a tent pole with first and second sections, comprising:

a tubular collar with a first end, a second end, and an inside diameter that is greater in diameter than an exterior diameter of the tent pole, the collar configured to receive a portion of the tent pole;

a circular flange disposed on the first end, the flange extending radially inward and having an inside diameter less than the inside diameter of the collar and less than the exterior diameter of the tent pole; and a coupling portion configured to receive the point on the tent canopy, wherein the collar is immobilized on the portion of the tent pole by passing a first section of the tent pole through the collar and abutting the first section against a first side of the circular flange, and abutting a second side of the circular flange against a second section of the tent pole, the second side of the circular flange forming part of an exterior of the coupler.

2. The coupler of claim 1, wherein the coupling portion is one of a hook, a snap, a clasp, a button, or a hook or loop material.

3. The coupler of claim 1, wherein the coupler is made from plastic.

4. The coupler of claim 1, wherein second section of the tent pole has an outer diameter, and the tent pole further comprises a ferrule with an outer diameter less than an inner diameter of the first and second sections of the tent pole, the outer diameter of the ferrule also less than the inside diameter of the circular flange.

5. A coupler for a tent, comprising:

a collar with a hollow center, defined by a first end and a second end;

a flange disposed on the first end extending radially into the hollow center, the flange having a first side facing into the follow center and a second side that is part of an exterior of the collar; and an attachment point disposed on the exterior of the collar, wherein the collar is configured to slide over an end of a first section of a tent pole inserted into the second end until the first section abuts the flange, the first section of the tent pole having an exterior diameter less than an interior diameter of the hollow center but greater than an interior diameter of the flange, and be retained to the first section of the tent pole by a second section of the tent pole that abuts the second side of the flange.

6. The coupler of claim 5, wherein the tent pole comprises a tube, the first section of the tent pole end is formed at least in part from a ferrule that is inserted into the second section of the tent pole, the ferrule having an exterior diameter less than the interior diameter of the flange, and the interior diameter of the flange is equal to an inner diameter of the second section of the tent pole.

7. The coupler of claim 5, wherein the attachment point comprises one of a hook, a snap, a clasp, a button, or a hook or loop material.

8. A system for providing a mount point for a tent, comprising:

a first tent pole section comprised of a tube;

a second tent pole section comprised of a tube; and a coupler comprising a hollow body and the mount point, wherein the coupler further comprises a flange disposed on an end of the coupler that extends radially inward with an inside diameter that is less than an inside diameter of the hollow body, the coupler retained between the first tent pole section and second tent pole section by sliding the first tent pole section through the hollow body until the first tent pole section is abutting a first side of the flange that faces the hollow body, and abutting the second tent pole section against a second side of the flange, the second side of the flange forming part of an exterior of the coupler.

9. The system of claim 8, wherein the mount point comprises coupling portion that extends from an exterior of the coupler.

10. The system of claim 8, wherein the end of the first tent pole section comprises a ferrule configured to insert into the end of each of the first tent pole section and second tent pole section.

11. The system of claim 10, wherein the flange inside diameter is equal to an outer diameter of the ferrule.

* * * * *